US011851899B1

(12) United States Patent
Wells

(10) Patent No.: US 11,851,899 B1
(45) Date of Patent: Dec. 26, 2023

(54) SYSTEM AND METHOD FOR A TEMPORARY PROTECTIVE BARRIER FOR FLOORS AND STAIRS DURING CONSTRUCTION AND DEMOLITION

(71) Applicant: Simon Wells, Fort Lauderdale, FL (US)

(72) Inventor: Simon Wells, Fort Lauderdale, FL (US)

( * ) Notice: Subject to any disclaimer, the term of this patent is extended or adjusted under 35 U.S.C. 154(b) by 0 days.

(21) Appl. No.: 18/238,106

(22) Filed: Aug. 25, 2023

Related U.S. Application Data

(60) Division of application No. 18/138,052, filed on Apr. 22, 2023, and a continuation-in-part of application No. 18/105,814, filed on Feb. 4, 2023.

(51) Int. Cl.
*E04G 21/30* (2006.01)

(52) U.S. Cl.
CPC ..... *E04G 21/30* (2013.01)

(58) Field of Classification Search
CPC ..... E04G 21/30; E04F 13/075
See application file for complete search history.

(56) References Cited

U.S. PATENT DOCUMENTS 3,895,981 A * 7/1975 Tesch ..... E04F 11/163 52/181
6,640,501 B1 * 11/2003 Hussey ..... E04G 21/30 52/177
7,228,668 B2 * 6/2007 Gibney ..... E04G 21/30 52/211
7,823,332 B2 * 11/2010 Siegel ..... A47G 27/0287 52/177
9,091,073 B2 * 7/2015 Wells ..... E04F 15/02
9,732,533 B2 * 8/2017 Ruzhin ..... E04G 21/30
9,945,137 B2 * 4/2018 Prest ..... E04G 21/30
9,956,568 B2 * 5/2018 O'Brien ..... B05C 21/005
10,570,623 B1 * 2/2020 Wells ..... E04F 11/17
10,676,939 B2 * 6/2020 Wells ..... E04G 21/30
11,002,028 B2 * 5/2021 Rus ..... E04G 21/30
11,149,452 B2 * 10/2021 Rus ..... E04G 21/30
11,293,193 B2 * 4/2022 Rus ..... E04F 11/163
11,486,156 B2 * 11/2022 Rus ..... E04F 11/163
2003/0196387 A1 * 10/2003 Hussey ..... E04G 21/30 52/3
2004/0261344 A1 * 12/2004 Gibney ..... E04G 21/30 52/506.01
2004/0261346 A1 * 12/2004 Gibney ..... E04G 21/30 52/506.01
2008/0066389 A1 * 3/2008 Siegel ..... A47G 27/0287 52/3

(Continued)

*Primary Examiner* — Rodney Mintz
(74) *Attorney, Agent, or Firm* — Melvin K. Silverman

(57) ABSTRACT

A temporary protective barrier system and method thereof for floors and stairs during construction and demolition. The system includes temporary stair tread covers, constructed of fluted plastic material, temporary stair riser protectors with top and bottom flaps creating an overlap between the riser covers and the stair tread covers, and a stair anchors configured to directionally secure the stair tread cover. A method of installation and use of the system is also provided herein. Elements such as adhesives and grip tapes are included to prevent movement of the system from the surfaces on which it covers, and adhesive tapes seal the seams between these elements to thereby enclose the systems.

11 Claims, 17 Drawing Sheets

(56) References Cited

U.S. PATENT DOCUMENTS

| | | | | |
|---|---|---|---|---|
| 2013/0236676 | A1* | 9/2013 | Doyle | E04G 21/30 428/57 |
| 2014/0157712 | A1* | 6/2014 | Wells | E04G 21/30 52/796.1 |
| 2015/0056401 | A1* | 2/2015 | Farah | B32B 37/22 156/547 |
| 2016/0312484 | A1* | 10/2016 | Ruzhin | E04G 21/30 |
| 2017/0183883 | A1* | 6/2017 | Rus | E04G 21/30 |
| 2017/0189925 | A1* | 7/2017 | O'Brien | B05B 12/28 |
| 2018/0347205 | A1* | 12/2018 | Rus | E04F 11/166 |
| 2018/0347215 | A1* | 12/2018 | Rus | E04F 11/104 |
| 2018/0347216 | A1* | 12/2018 | Rus | E04F 11/104 |
| 2018/0353051 | A1* | 12/2018 | Clark | A47L 13/10 |
| 2019/0085572 | A1* | 3/2019 | Rus | E04G 21/30 |
| 2020/0040585 | A1* | 2/2020 | Wells | E04F 11/163 |
| 2020/0123781 | A1* | 4/2020 | Wells | E04F 11/1045 |
| 2020/0332543 | A1* | 10/2020 | Rus | E04F 11/163 |

* cited by examiner

SYSTEM AND METHOD FOR A TEMPORARY PROTECTIVE BARRIER FOR FLOORS AND STAIRS DURING CONSTRUCTION AND DEMOLITION

CROSS-REFERENCE TO RELATED APPLICATIONS

This application is a divisional of co-pending application Ser. No. 18/138,052, entitled: "A System and Method for a Temporary Protective Barrier for Floors and Stairs During Construction and Demolition", which is a continuation in part of co-pending application Ser. No. 18/105,814, entitled: "System and Method for a Temporary Protective Structure for Use in Construction and Demolition", filed Feb. 4, 2023, all of which is incorporated by reference in its entirety.

FIELD OF THE INVENTION

The present invention relates temporary structures used in construction and demolition.

BACKGROUND

When the interiors of Yachts and other high-end vehicles/crafts are being refitted, not all surfaces and interiors are demolished. Because these remaining high-end fixtures and surfaces are vulnerable to damage from debris and loose articles from demolition, it is important to include protections against such damage. While no solution exists in the marine industry, systems in general construction and building include scaffolding and plastic tarps, typically duct taped together to contain dust. However, this setup does not protect flooring, walls, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

When the interiors of Yachts and other high-end vehicles, crafts, buildings, homes, and the like are being refitted, the rooms being demolished and remodeled are typically nestled down a maze of corridors and stairways. Thus, a need exists in the market for a temporary protective barrier that is configurable to protect unaltered areas of a structure under renovation and provide enhanced protection for the surfaces outside the barrier so that damage does not occur.

My previously filed U.S. patent application Ser. No. 18/105,814, entitled "A SYSTEM AND METHOD FOR A TEMPORARY PROTECTIVE STRUCTURE FOR USE IN CONSTRUCTION AND DEMOLITION" disclosed a system and method of a temporary protective structural system that focused on the overall system employed. That system includes a plurality of frame members. The frame members define a pair of opposing studs and integrated top plate. The system also includes noggings connecting the studs. Ceiling joists are also included. The combination creates at least one free-standing tunnel module. Vertical wall panels are secured to the exteriors of the free-standing tunnel modules, thereby vertically enclosing the free-standing tunnel modules. Horizontal ceiling panels are secured to an exterior ceiling area of the tunnel modules. Horizontal floor panels provide a protective surface for the floor. When constructed, the combination of elements and tunnel modules create a protective barrier for sensitive surfaces in a construction zone. However, more consideration needs to be given to floor systems that may be easily applied to staircases to ensure that the system works in the most sensitive areas, going up and down stairs. The disclosure herein provides the solution for this problem in an easily executable configuration.

SUMMARY OF THE INVENTION

The invention disclosed herein provides a temporary protective barrier system for floors and stairs during construction and demolition. The temporary protective barrier system for floors and stairs during construction and demolition includes at least one temporary stair tread cover, constructed of fluted plastic material. The system further includes at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover. The system also includes at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover.

Yet further provided is at least one temporary stair tread cover, constructed of fluted plastic, and at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover.

Additionally, the system includes at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover.

The invention disclosed herein also provides a method of providing surface protection during at least construction and demolition. The method of providing surface protection during at least construction and demolition includes the steps of providing at least one temporary stair tread cover, constructed of fluted plastic, providing at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover, and providing at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover.

The method also includes the steps of measuring a length and height of a stairwell was from a tread to an underside of a handrail, providing a sheet of fluted plastic material forming a wall panel and resting said sheet fluted plastic material on an edge of the treads, and securing the sheet to a wall using the handrail mounting point as an anchor. Further, the method includes measuring a width and depth of the tread, ensuring all treads are equivalent in dimension, and cutting the stair tread cover down to a size equivalent to the width and depth of the tread, if modification is required to match the dimensions. Additionally, the method includes measuring a height of a stair riser, modifying the stair riser protector if a smaller size is required, ensuring two inches of overlap of between the top flap and upper stair tread cover, and two inches of overlap between the bottom flap and bottom stair tread cover, once folded, and installing the stair riser protector on the stair. Finally, the method incudes measuring the width of the tread to confirm its dimension, modifying the stair anchor to assimilate its width with the depth of the tread, modifying the stair anchor's height to conform with a height equivalent to two-inches above the height of the stair riser, wherein the lower two-inches are folded inward and affixed to the stair tread cover, and installing the stair anchor against the wall sheet, securing all overlap points with adhesive tape.

The invention disclosed herein also provides an enhanced temporary protective structural system. The enhanced temporary protective structural system includes a plurality of frame members including at least a first frame member and at least a second frame member, wherein each frame member in said plurality of frame members is a unitary frame element comprising a pair of opposing studs and integrated top plate connecting said pair of opposing studs at an upper integration point. The system also includes a plurality of noggings connecting a first stud of said pair of opposing studs of said first frame member in said plurality of frame members with a first stud of said pair of opposing studs of said second frame member in said plurality of frame members, and a plurality of noggings connecting a second stud of said pair of opposing studs of said first frame member in said plurality of frame members with a second stud of said pair of opposing studs of said second frame member in said plurality of frame members, thereby forming at least one free-standing tunnel module. Additionally, a plurality of ceiling joists connecting said top plate of each of said first frame members to a top plate of each of said second frame members, thereby securing said at least one free-standing tunnel module are provided.

Additionally, the system includes several panels, including at least one vertical wall panel secured to an exterior area of said at least one free-standing tunnel module, thereby vertically enclosing said at least one free-standing tunnel module, at least one horizontal ceiling panel secured to an exterior ceiling area of said at least one free-standing tunnel module, and at least one horizontal floor panel, whereby said at least one horizontal ceiling panel and said at least one floor panel horizontally enclose said at least one free-standing tunnel module.

Lastly, the system includes stair coverings, including at least one temporary stair tread cover, constructed of fluted plastic, and at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of the direction of the top folded flap, thereby creating an overlap between said top folded flap and an upper stair tread cover of said at least one stair tread cover and an overlap between said bottom folded flap and a lower stair tread cover of said at least one stair tread cover. In addition, at least a pair of stair anchors configured to directionally secure the stair tread cover are provided, wherein each stair anchor in said pair of stair anchors includes a vertical main body with a horizontal fold line, wherein once folded, a bottom folded flap horizontally extends away from the main body and overlaps said stair tread cover.

It is an object of the present invention to provide a system capable of being readily assembled and disassembled with minimal pieces outside the overall system.

It is yet another object of the present invention is to provide a system that can be used to create a protective barrier on flooring and stairs from a demolition or construction area to the outside of the structure where the threat of damage is no longer present.

It is a further object to provide a system that incorporates cushioned material to shield exposed surfaces of the structure.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
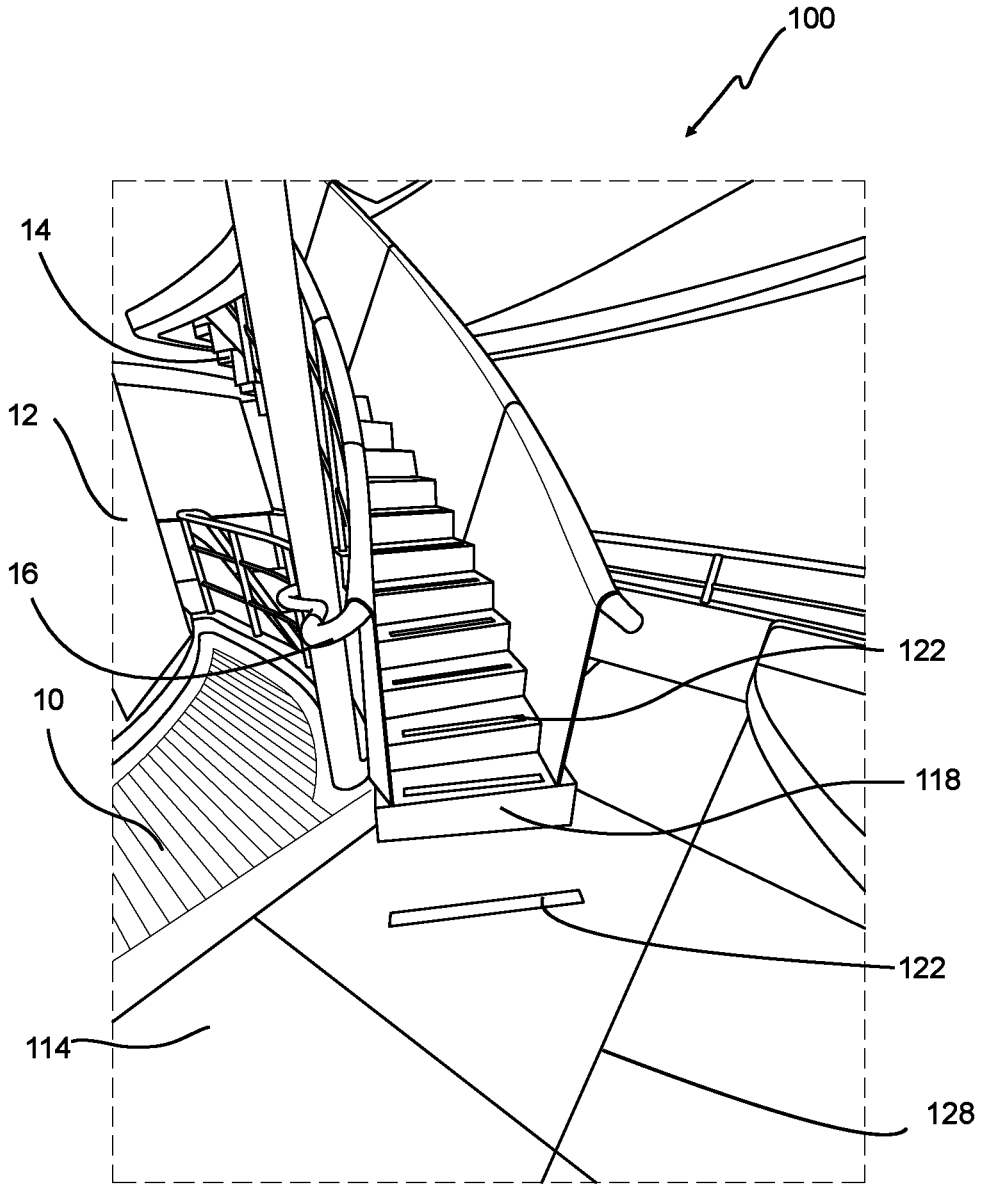
FIG. 1 illustrates a conceptual view of the protective product covering a stairwell of a marine craft.

The invention herein provides a solution for protecting and maintaining the safety and integrity of unaltered fixtures and surfaces during demolition and construction. The invention includes a uniquely configured barrier system that includes coverings for the stairs (both riser and tread), that is customizable in size and volume, and includes an anchor system to protect flooring and stairs during construction and demolition. This system compliments a frame element system, as I've described, having members connecting several frame elements to create a frame skeleton. Several protective panels surrounding the skeletal frame are incorporated to provide for protection and containment. This unique arrangement, in combination, is capable of solving the above issues plaguing current methods of protection during construction.

As stated above, when the interiors of Yachts and other high-end vehicles/crafts are being refitted, not all surfaces and interiors are demolished. Because these remaining high-end fixtures and surfaces are vulnerable to damage from debris and loose articles from demolition, it is important to include protections against such damage. While no solution exists in the marine industry, systems in general construction and building include scaffolding and plastic tarps, typically duct taped together to contain dust. However, this setup does not protect flooring, walls, and other surfaces from heavier debris, and damage can occur if something is dropped. Typically, builders may include cardboard squares on the floor, however these squares can slide and scrape the floors they're intended to protect. In addition, when leaving these protected areas, there is typically no protection for rooms being left unaltered. That is, the scaffolding, tarps, and cardboard only exist in the construction area.

To appreciate the current invention, it is also important to understand the context of the overall system. The overall system, as disclosed in my previous U.S. patent application Ser. No. 18/105,814, entitled "A SYSTEM AND METHOD FOR A TEMPORARY PROTECTIVE STRUCTURE FOR USE IN CONSTRUCTION AND DEMOLITION", which is incorporated herein by reference in its entirety, incorporates numerous features to protect the surfaces of the location under renovation. It begins with incorporation of linear protective sheets to cover at least the flooring, as well as sensitive areas like walls, stairs, and railings. These protective sheets are constructed of a plastic material, and arranged with a first upper plastic surface, and a lower plastic surface, connected by plastic fluting thereby providing depth and cushion. The sheets are typically square or rectangular sheets with a linear slice through the first upper plastic sheet and the fluting to allow foldability. However, such sheets may also be cut to size and shape for unique applications. As the sheets are placed around, they are secured to the protected surface by an adhesive. Further, the sheets are then secured to each other by implementing an adhesive tape. Because the sheets are constructed of a plastic material, the incorporation of an adhesive tape creates a water-resistant surface. In addition, are areas of potential slippage, such as stair treads, an adhesive grip is used.

Once the protective sheets are in place, a skeletal frame may be constructed for the tunnel element of the system. The frame incorporates a unitary U-shaped frame element of fluted plastic material to keep the frames light and durable. It is important not to use any heavy materials so as to not pose a thread of damage to the underlying floorspace. The U-shaped frame element includes vertical members, typically called studs in frame construction, and an upper connecting member, known as a top plate in frame construction. The frame includes notches for integrating with other members of the system to provide an easily constructable and de-constructable temporary structure. The U-shaped frame elements are connected to one another by horizontal members, typically called noggins and a plurality of upper horizontal members, typically called ceiling joists. Each component is constructed of the same fluted plastic material for durability and lightness.

The U-shaped frame elements, noggins, and ceiling joists all connect through complemental notches cut into each component. Once pressed into place, the elements for a tunnel module. Footings may also be used to help the modules stand independently. These tunnels are modular and may be arranged in series to provide a continuous tunnel from a starting point inside a construction zone, to an end point beyond areas at risk of damage.

Panels may be installed enclosing the modular tunnel frames once the tunnel frames are secured. These panels provide containment of the contents flowing through the tunnels, and are secured together with adhesive tape so that the tunnels are self-contained. It is to be appreciated that the sheets on the floor, panels forming the ceiling, and panels forming the wall may all the same, thereby reducing the unique number of parts to ensure maximum flexibility and quickness of construction. These panels/sheets are all constructed of fluted plastic material. The fluting ensures cushion to falling objects, while the use of plastic allows the sheets/panels to elastically resume their shape, provide an impermeable water-resistant surface, and are lightweight to provide for ease of construction and avoid potential damage to the floor surface below. By incorporating an adhesive material on each sheet, the sheets can affix to different surfaces, frames, and floors without the explicit need for adhesive tape. This ensures that the sheets/panels do not shift or slip. This aspect offers a significant benefit during construction because panels are not moving while they remain unsecured, and offers a significant benefit for surfaces because they remain in place while the tunnels are in use.

On final construction, the tunnels are sealed off with adhesive tape, and may incorporate plastic zipper doors, thereby sealing the tunnel off from unprotected areas of the construction zone and non-construction zone. Further, junctions of tunnels may be formed as well. Junctions may be sealed off with adhesive tape, and may be open on the inside, or may also contain plastic zipper doors separating individual hallways within the tunnel system.

When the interiors of high-end vehicles and crafts (like superyachts) and structures like buildings and residential homes are being refitted, the rooms being demolished and remodeled are typically nestled down a maze of corridors and stairways. While my previously disclosed invention discusses the modular tunnel system, this disclosure introduces the unique floor and stair covering that should be employed, even in projects that do not require a full tunnel module. Thus, a need exists in the market for a temporary protective barrier for floors and stairs during construction and demolition that is configurable to protect unaltered foot surfaces of a vehicle, craft, building, and/or structure under renovation and provide enhanced protection for the surfaces under the barrier so that damage does not occur.

The current invention solves these problems by utilizing a unique component-based system having several parts, thereby ensuring scalability and customizability to fit each unique application. The stair tread covers may be cut to size so that there is no overhang, and the insulative fluted material may fit snuggly. Because the tread cover is configurable to size, a riser protector is also included to protect the vertical elements of the stairs. However, to ensure full coverage, the system is provided with a sufficient but minimal overlap. In order to keep these components in place, an adhesive material may be placed at the backing, to provide a temporary affixion to the stair's surfaces, but anchors are also used to secure the system to the wall/sidewall/side stair lip. While all of these components have adhesive elements, dust and debris, as well as liquids, may seep through any cracks, and therefore, a flexible adhesive tape is included that can be cut to size to configurably seal these open areas. In doing so, the adhesive tape also provides an additional level of anchoring within the components themselves. Finally, grip tape is placed on each stair tread cover because of the smooth surface of the tread cover. While embodiments may employ a rough or course upper surface texture, this would require additional steps in manufacturing, and could make the system financially inefficient. Therefore, while a rough material is in the scope of the current invention, it is ideal to include an applyable grip tape, thereby allowing ease of manufacturing.

The temporary protective barrier for floors and stairs during construction and demolition of the present invention may be used to, among other things, provide a system capable of being readily assembled and disassembled with minimal pieces outside the overall system, to provide a system that can be used to create a protective barrier on flooring and stairs from a demolition or construction area to the outside of the structure where the threat of damage is no longer present, and to provide a system that incorporates cushioned material to shield exposed surfaces of the structure. This apparatus and system are particularly shown in FIGS. 1-17.

Figure 2:
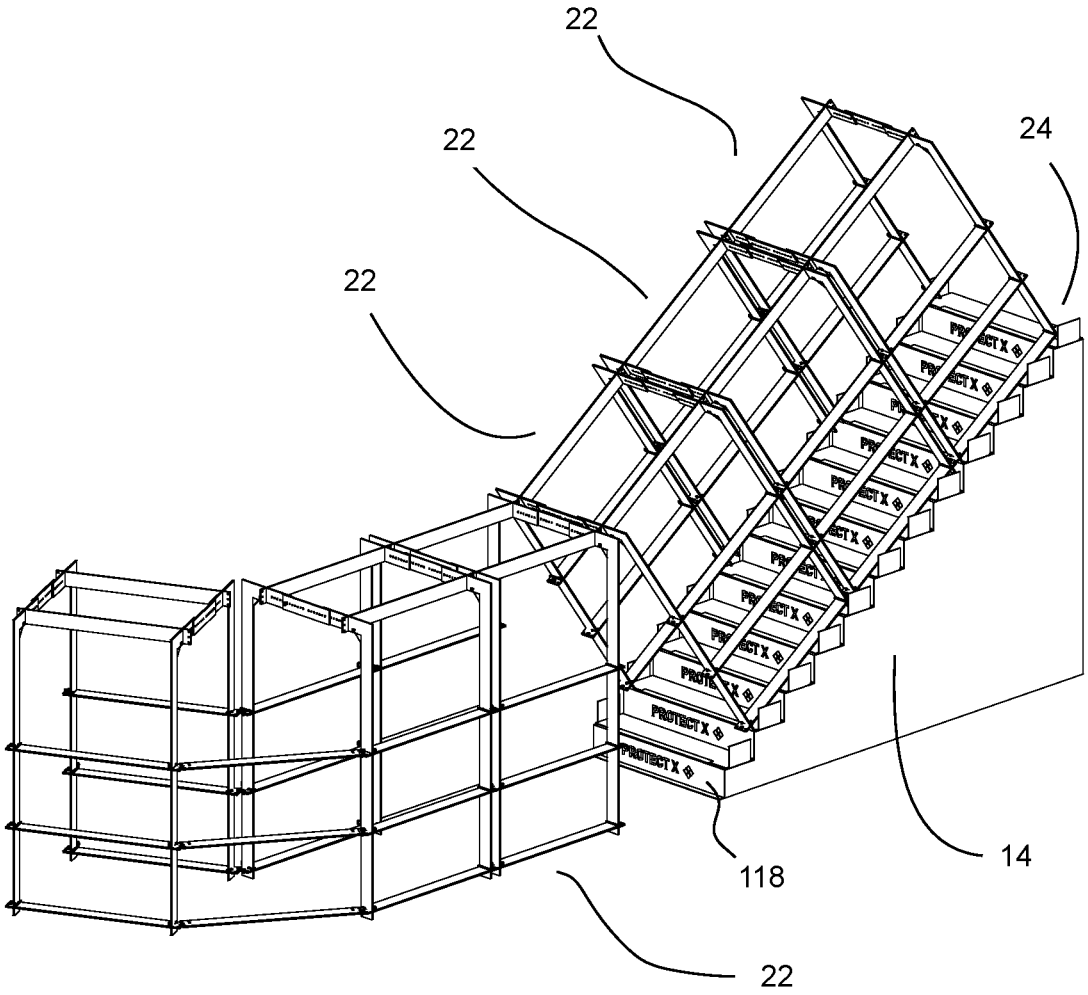
FIG. 2 illustrates an isometric view of a full modular protection system.
Figure 3:
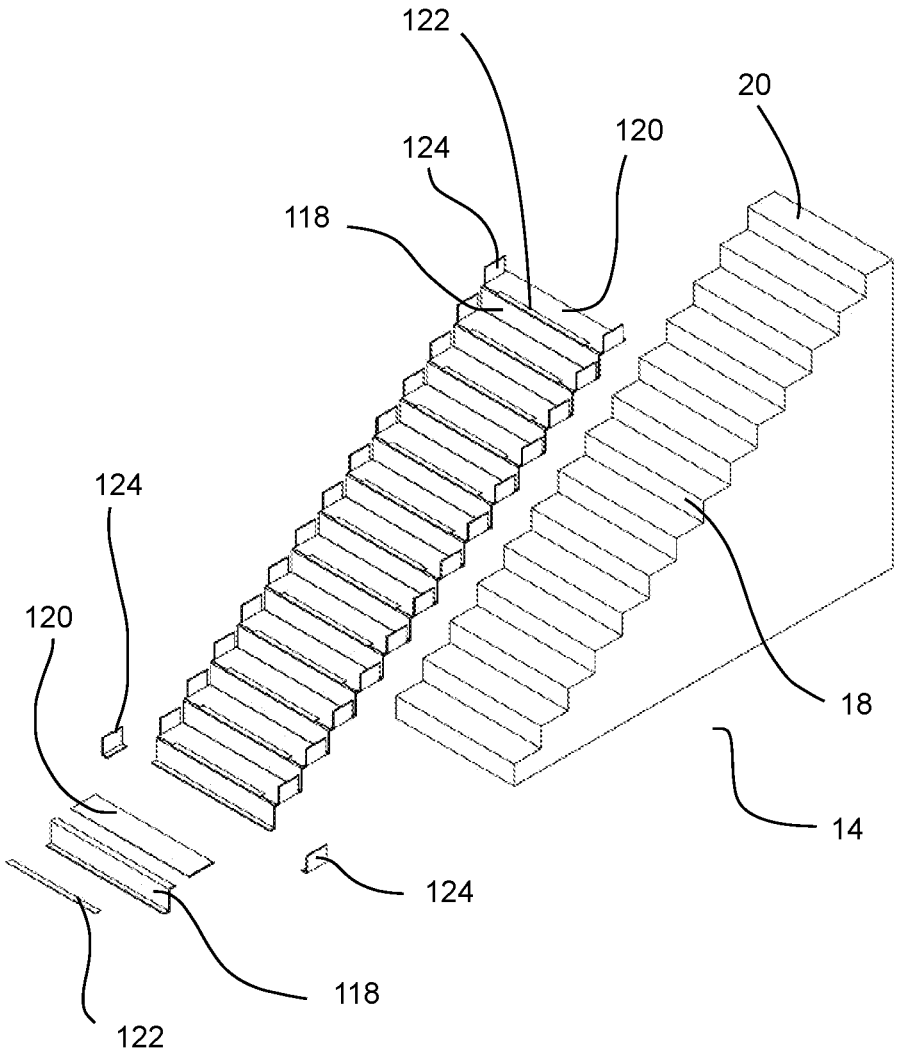
FIG. 3 illustrates an isometric exploded view of the staircase covering components.
Figure 4:
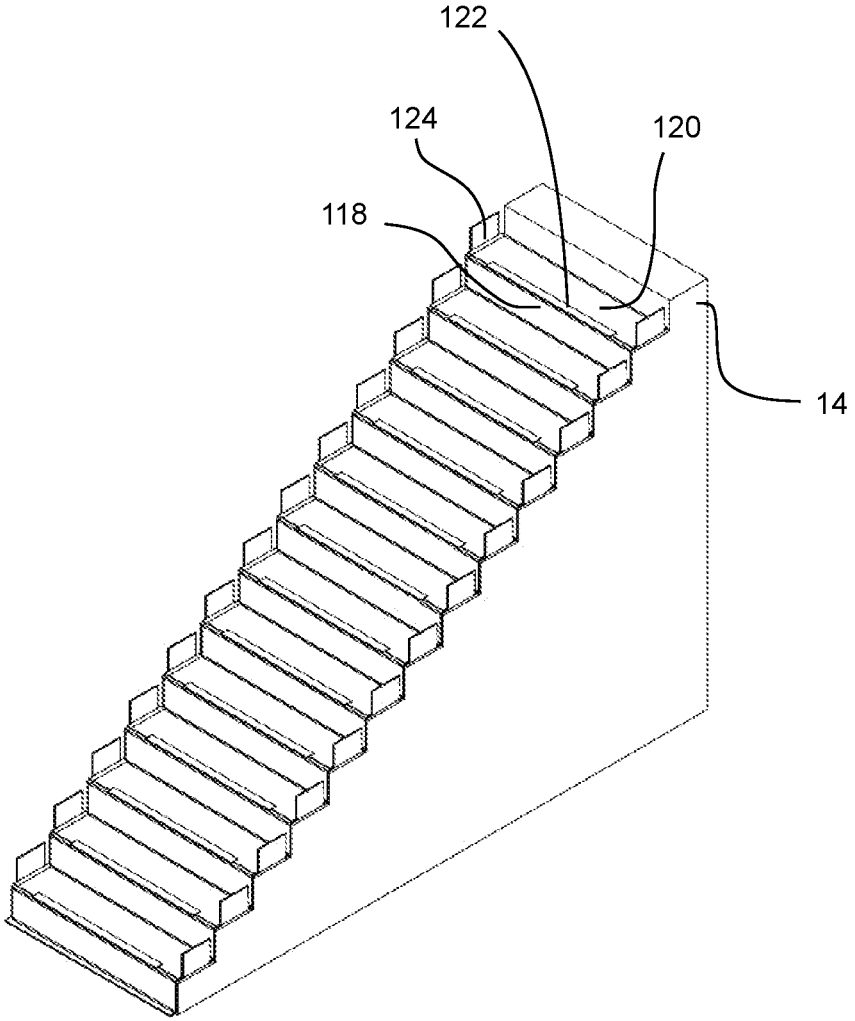
FIG. 4 illustrates an isometric view of the staircase covering components.

FIG. 1 illustrates a conceptual view of the protective product 100 covering a stairwell 14 of a marine craft. FIG. 2 illustrates an isometric view of a full modular protection system 22 and staircase protection system 24. FIG. 3 illustrates an isometric exploded view of the staircase 14 covering components 118/120/122/124. FIG. 4 illustrates an isometric view of the staircase 14 covering components 118/120/122/124.

Figure 5:
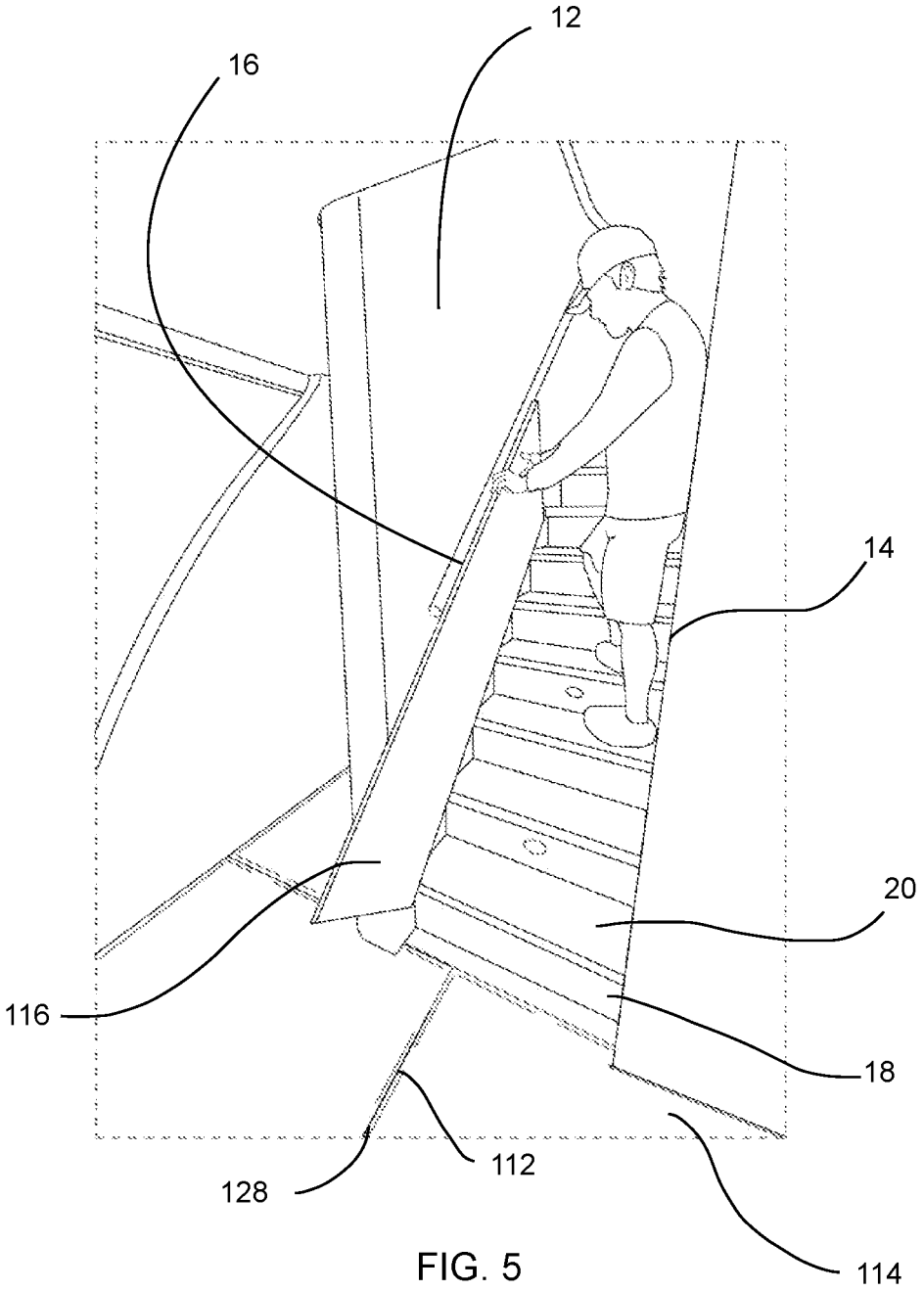
FIG. 5 illustrates a conceptual view of the product being installed on a staircase area.
Figure 6:
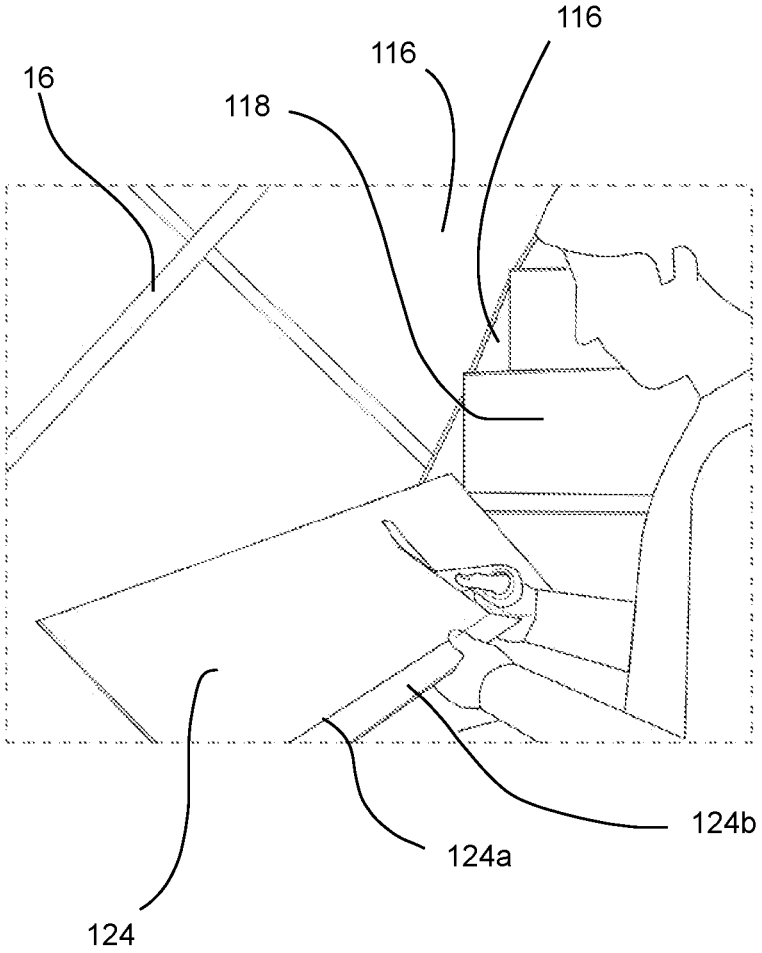
FIG. 6 illustrates a conceptual view of the product being installed on a staircase area.
Figure 7:
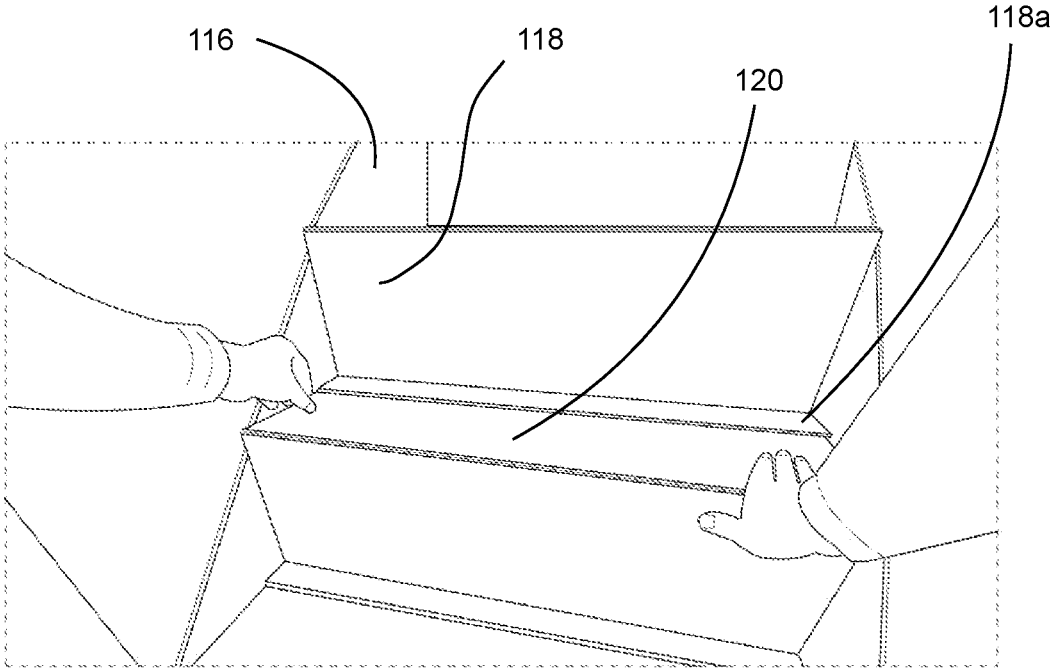
FIG. 7 illustrates a conceptual view of the product being installed on a staircase area.
Figure 8:
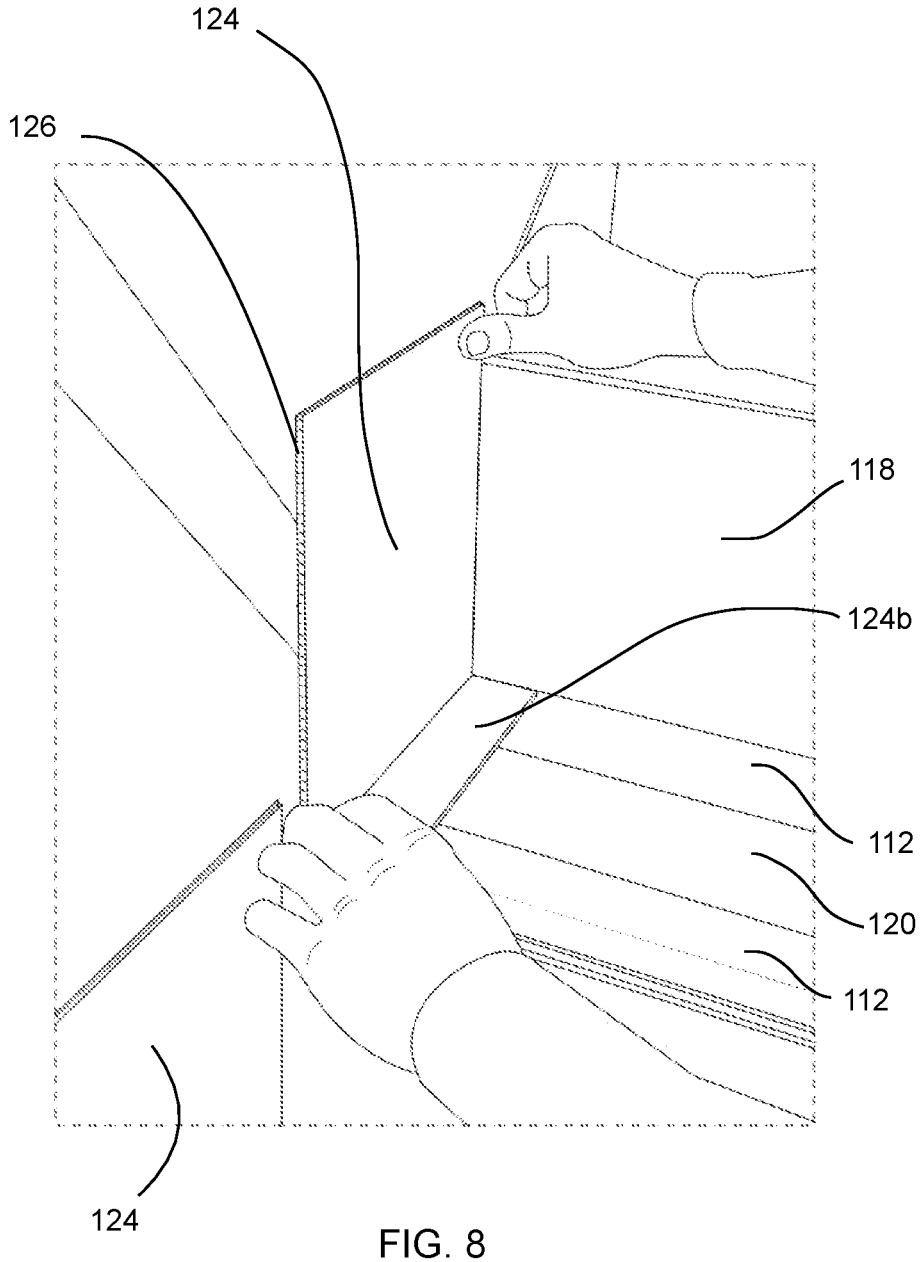
FIG. 8 illustrates a conceptual view of the product being installed on a staircase area.
Figure 9:
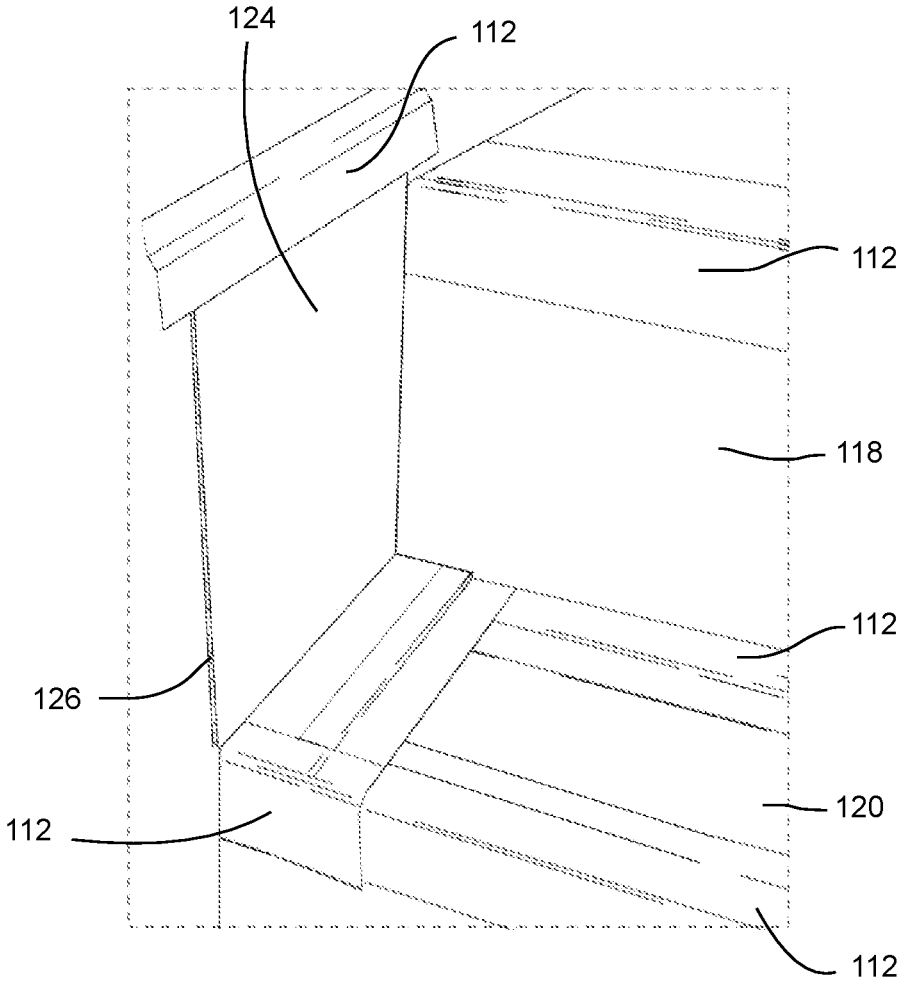
FIG. 9 illustrates a conceptual view of the product being installed on a staircase area.
Figure 10:
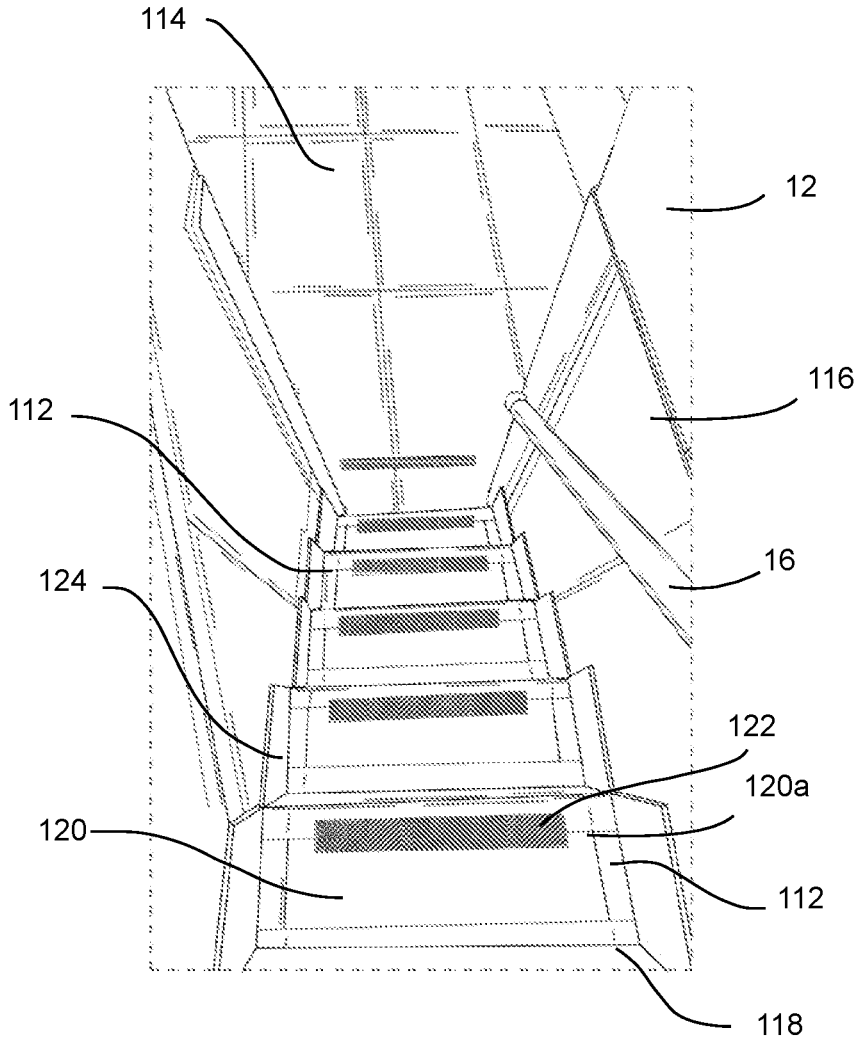
FIG. 10 illustrates a conceptual view of the product installed on a staircase area.
Figure 11:
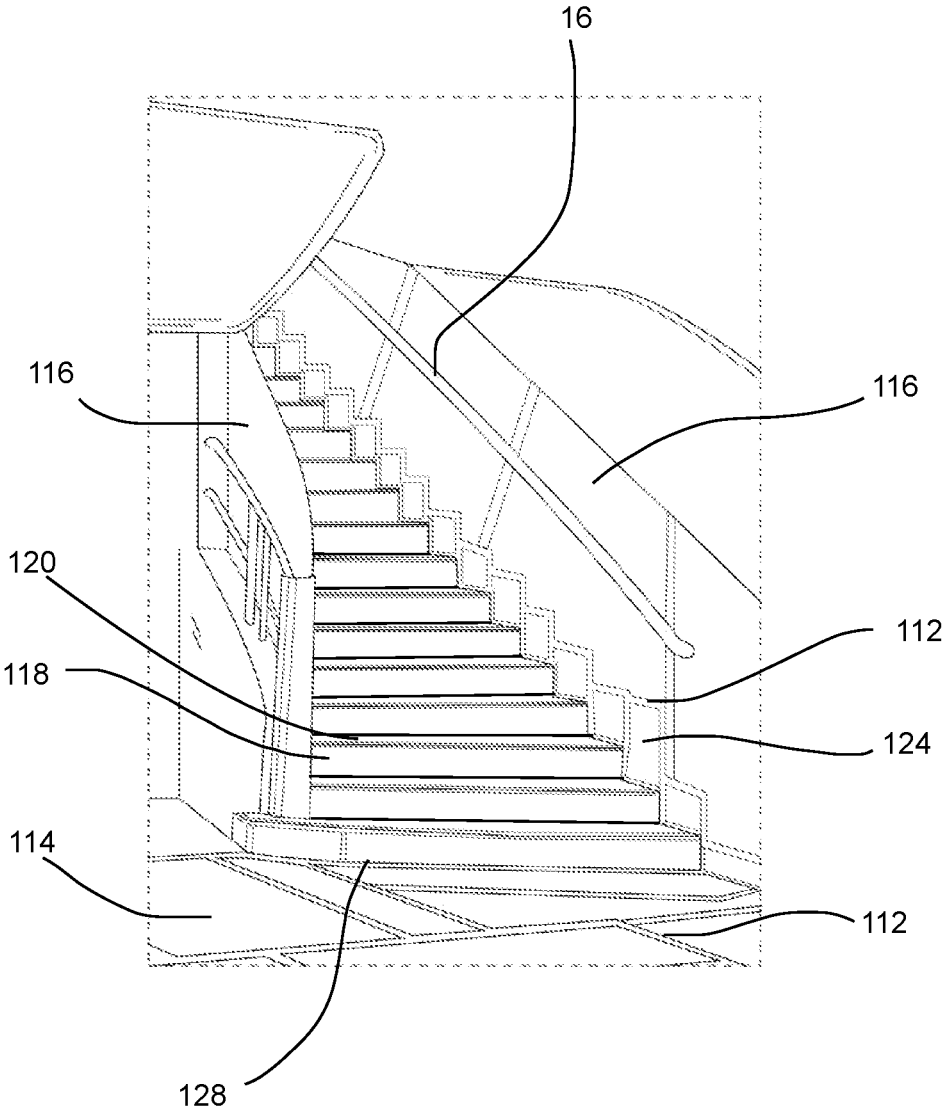
FIG. 11 illustrates a conceptual view of the product installed on a staircase area.

FIG. 5 illustrates a conceptual view of the product 116/114 being installed on a staircase area 14, wherein a user is seen installing a wall panel 116 along the side of the stairs 14, including riser 18 and tread 20. As may be appreciated, the flooring cover 114 is installed on the floor and secured to one another with adhesive tape 112, though at this point the stair treads 20 and risers 18 are still unprotected. FIG. 6 illustrates a conceptual view of the product 116/118/124 being installed on a staircase area, wherein a user cuts a wall anchor 124 to size. The stair anchors 124 will usually need to be cut to fit because of varying tread depths, though standard sizes may come pre-cut. As may be appreciated, the stairs are covered by the tread cover (not shown at this angle) and the riser protector 118 FIG. 7 illustrates a conceptual view of the product 116/118/120 being installed on a staircase area, wherein the user secures the stair tread cover 120 It may also be appreciated that the riser protectors 118 are also installed. FIG. 8 illustrates a conceptual view of the product 112/118/120/124 being installed on a staircase area, wherein a user is shown securing the stair anchor 124. FIG. 9 illustrates a conceptual view of the product 112/118/120/124 being installed on a staircase area, showing an installed stair anchor 124 secured with adhesive tape 112. From this enlarged view, the fluted material 126 may also be seen. FIG. 10 illustrates a conceptual view of the product 112/114/116/118/120/122/124 installed on a staircase area, wherein the flooring covers 114, wall coverings 116, riser covers 118, tread covers 120, grip tapes 122, and stair cover anchors 124 are all secured in place, and sealed off with adhesive tape 112. FIG. 11 illustrates a conceptual view of the product 112/114/116/118/120/124 installed on a staircase 14 area.

Figure 12:
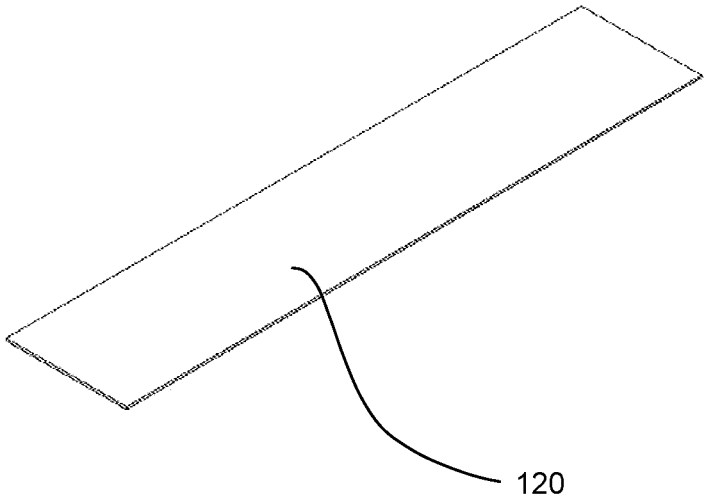
FIG. 12 illustrates an isometric view of a tread cover.
Figure 13:
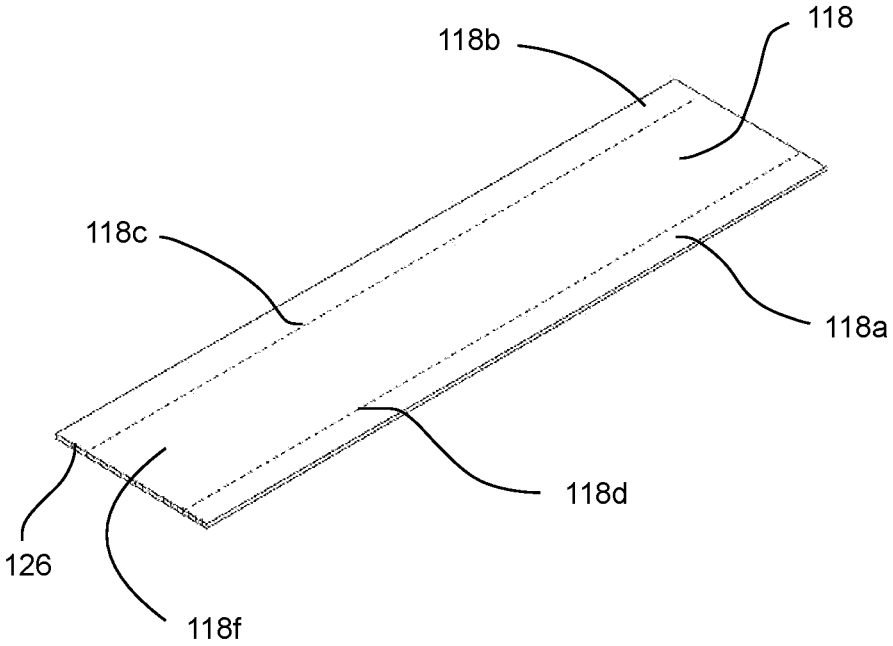
FIG. 13 illustrates an isometric view of an unfolded riser protector.
Figure 14:
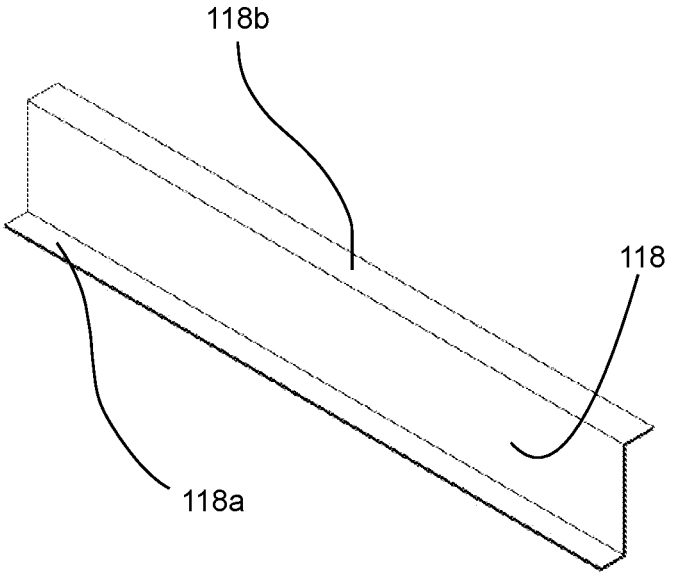
FIG. 14 illustrates a front isometric view of a folded riser protector.
Figure 15:
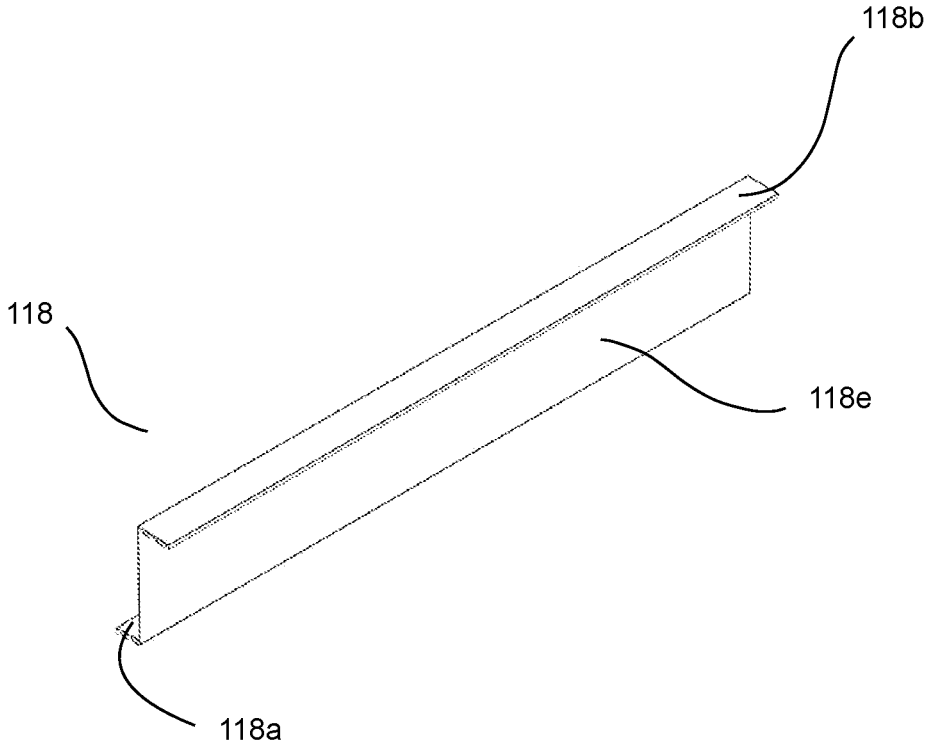
FIG. 15 illustrates a rear isometric view of a folded riser protector.
Figure 16:
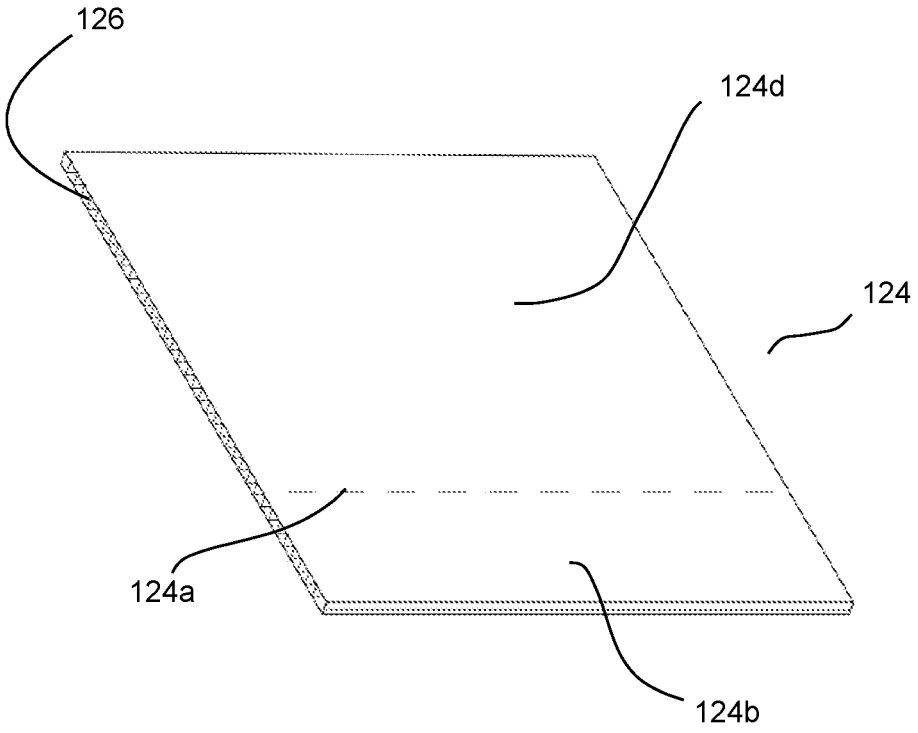
FIG. 16 illustrates a front isometric view of an unfolded stair anchor.
Figure 17:
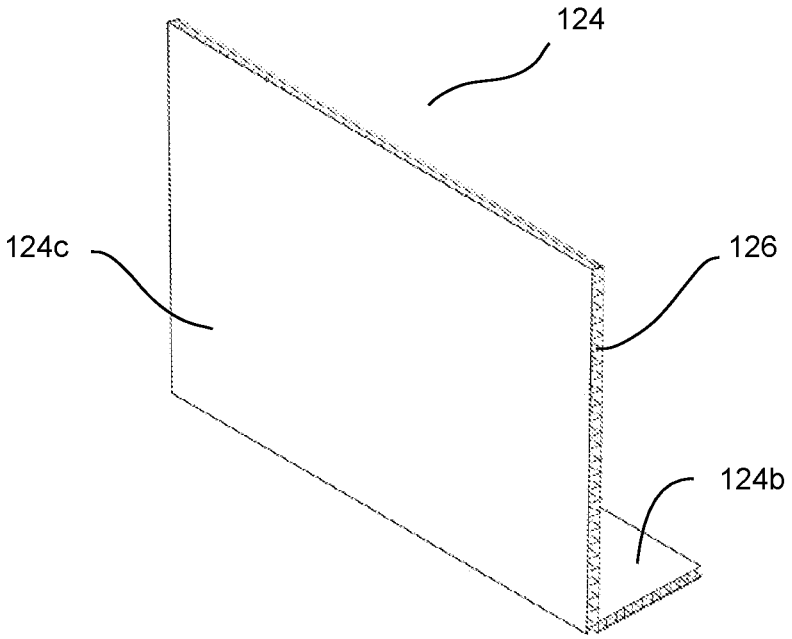
FIG. 17 illustrates a rear isometric view of a folded stair anchor.

FIGS. 12-16 show the individual pieces that make up the flooring and stair protection system. FIG. 12 illustrates an isometric view of a tread cover 120 FIG. 13 illustrates an isometric view of an unfolded riser protector 118. FIG. 14 illustrates a front isometric view of a folded riser protector 118. FIG. 15 illustrates a rear isometric view of a folded riser protector 118. FIG. 16 illustrates a front isometric view of an unfolded stair anchor 124. FIG. 17 illustrates a rear isometric view of a folded stair anchor 124.

In an exemplary embodiment, a temporary protective barrier system 100 for floors 10 and stairs 14 during construction and demolition is disclosed. The exemplary embodiment includes at least one temporary stair tread cover 120, constructed of fluted plastic, and at least one temporary stair riser protector 118. The at least one temporary stair riser protector 118 has a vertically oriented main body **118*f* with two fold lines 118*c*/118*d* running parallel to a width of the main body, thereby defining said main body. Once folded, a top folded flap 118*b* horizontally extends away from the main body 118*f*, and a bottom folded flap 118*a*, horizontally extends away from the main body 118*f* in a direction opposite of the direction of the top folded flap 118*b*, as may be seen in FIGS. 14-15. This creates an overlap between said top folded flap 118*b*/118*a* and an upper stair tread cover of said at least one stair tread cover 120 and an overlap between said bottom folded flap 118*a* and a lower stair tread cover of said at least one stair tread cover 120. The exemplary embodiment also includes at least a pair of stair anchors 124 configured to directionally secure the stair tread cover 120. Each stair anchor 124 in said pair of stair anchors 124 includes a vertical main body 124*d* with a horizontal fold line 124*a*. Once folded, a bottom folded flap 124*b* horizontally extends away from the main body 124*d* and overlaps said stair tread cover 120, as may be seen in FIGS. 8 and 9**.

In some embodiments, the temporary protective barrier system for floors and stairs during construction and demolition includes an adhesive element on a stair-facing engagement surface (not shown, but may be appreciated as a mirror image of the surfaces shown in FIG. 12) of each of said at least one temporary stair tread cover 120. This adhesive may come pre-applied to the sheets 120, with a protective film to be removed, thereby exposing the adhesive material. The adhesive may stick to the surface of the tread 20, but is not strong enough to permanently bond the sheets 120, or bond them so strong that removal causes damage. The primary reason for the adhesive is to create a surface that does not slide over the smooth stair 14 tread 20 surface when lateral forces from a user going up and down stairs 14 is applied.

In some embodiments, the temporary protective barrier system for floors and stairs during construction and demolition includes an adhesive element on a stair-facing engagement surface 118*e* of each of said at least one temporary stair riser protector 118, with similar engagement as described above, as shown in FIG. 15.

In some embodiments, the temporary protective barrier system for floors and stairs during construction and demolition includes an adhesive element on a back side 124*c* of said stair anchor 124, whereby once folded along said fold line 124*a*, said adhesive element on said back surface 124*c* engages with both a wall 12 or wall covering 116, and a stair tread cover 120, as may be seen in FIGS. 8-9, with similar engagement as described above.

In several embodiments of the temporary protective barrier system for floors and stairs during construction and demolition includes at least one floor panel 114 constructed of fluted plastic material. The primary purpose of using the fluted material (see enlarged views emphasizing fluted material 126 of FIGS. 13, 16, and 17) is to maintain a lightweight but insulative material that can absorb impact. While fluted material 126 may be the ideal material, equivalent materials may also be used.

In some embodiments, the at least one floor panel 114 includes an adhesive element on an underside (not shown, but may be appreciated as the mirror images of shown sides) of each floor panel 114 of said at least one floor panel, whereby said adhesive element allows said floor panel 114 to temporarily secure said floor panel to an underlying floor 10. This panel has similar engagement as described above. In some embodiments, this floor covering may be constructed of fluted plastic material.

In some embodiments, the at least one wall panel 116 includes an adhesive element on an outside surface of each wall panel of said at least one wall panel 116, whereby said adhesive element allows said wall panel to temporarily secure said wall panel to a bordering wall of said staircase. This embodiment includes similar engagement as described above.

In some embodiments, an adhesive element is present on a back side 124*c* of said stair anchor 124, whereby once folded along said fold line 124*a* said adhesive element on said back surface 124*c* engages with both a wall 12 or wall covering 116, and a stair tread cover 120. This embodiment includes similar engagement as described above.

In some embodiments, the temporary protective barrier system 100 for floors and stairs during construction and demolition includes at least one unit of adhesive grip take 122, wherein said grip tape 122 is configured to engage at an upper forward surface 120*a* of each of said stair tread covers 120 (which may be appreciated in FIG. 10). The embodiment may also include an adhesive sealing tape 122 configurable to seal seams 128 (See, for example, FIG. 1) between at least one of a pair component configurations, including seams between a pair of floor panels 114 as may be seen in FIGS. 1 and 5, seams between a floor panel 113 and a stair riser protector 118 as may be seen in FIG. 11, seams between a floor panel 114 and a stair anchor 124, seams between a wall covering panel 116 and a stair anchor 124 as may be seen in FIG. 9, seams between a floor panel 114 and a wall covering panel 116, seams between a stair anchor 124 and a stair tread cover 120 as may be seen in FIG. 9, seams between a stair tread cover 120 and a stair riser protector 118 as may be seen in FIG. 9, and seams between a stair riser protector 118 and a stair anchor 124, whereby said sealing tape 112 provides additional anchorage between each component, and keeps dust and liquid from seeping between said components.

In another exemplary embodiment, a method of providing surface protection during at least construction and demolition is disclosed. The method begins with the step of providing numerous components, including at least one temporary stair tread cover 120, constructed of fluted plastic, at least one temporary stair riser protector 118, having a vertically oriented main body 118*f* with two fold lines 118*c*/118*d* running parallel to a width of the main body 118*f*, wherein once folded, a top folded flap 118*b* horizontally extends away from the main body 118*f*, and a bottom folded flap 118*a* horizontally extends away from the main body 118*f* in a direction opposite of the direction of the top folded flap 118*b*, thereby creating an overlap between said top folded flap 118*b* and an upper stair tread cover 120 of said at least one stair tread cover 120 and an overlap between said bottom folded flap 118*a* and a lower stair tread cover 120 of said at least one stair tread cover 120, and at least a pair of stair anchors 124 configured to directionally secure the stair tread cover 120, wherein each stair anchor 124 in said pair of stair anchors 124 includes a vertical main body 124*d* with a horizontal fold line 124*a*, wherein once folded, a bottom folded flap 124*b* horizontally extends away from the main body 124*d* and overlaps said stair tread cover 120.

The method includes the step of measuring a length and height of a stairwell 14 from a tread 20 to an underside of a handrail 16, providing a sheet of fluted plastic material forming a wall panel 116 and resting said sheet fluted plastic material 116 on an edge of the treads as shown in FIG. 5, and securing the sheet 116 to a wall 12 using the handrail 16 mounting point as an anchor.

The method also includes the step of measuring a width and depth of the tread 20, ensuring all treads 20 are equivalent in dimension, and cutting the stair tread cover 120 down to a size equivalent to the width and depth of the tread 20, if modification is required to match the dimensions, and installing the tread cover 120 over the tread 20, as shown in FIG. 7.

The method also includes the step of measuring a height of a stair riser 18, modifying the stair riser protector 118 if a smaller size is required, ensuring two inches of overlap of between the top flap 118*b* and upper stair tread cover 120, and two inches of overlap between the bottom flap 118*a* and bottom stair tread cover 120, once folded, and installing the stair riser protector 118 on the stair 14, as shown in FIG. 7, and measuring the width of the tread to confirm its dimension, modifying the stair anchor 124 to assimilate its width with the depth of the tread 20, as shown in FIG. 6, modifying the stair anchor's 124 height to conform with a height equivalent to two-inches above the height of the stair riser 18, wherein the lower two-inches are folded inward and affixed to the stair tread cover 120, as shown in FIG. 8, and installing the stair anchor 124 against the wall sheet 116, securing all overlap points with adhesive tape 112, as shown primarily in FIGS. 9 and 10.

In some embodiments of the method of providing surface protection during at least construction and demolition, the method further includes the step of installing a non-skid adhesive tape 122 to a top surface of said stair tread cover 120 one-inch from the forward edge of the tread 20.

In another exemplary embodiment, an enhanced temporary protective structural system is provided 120. The enhanced temporary protective structural system 120 includes several elements, which can be seen in my disclosure in application Ser. No. 18/105,814. These elements include a plurality of frame members including at least a first frame member and at least a second frame member, wherein each frame member in said plurality of frame members is a unitary frame element comprising a pair of opposing studs and integrated top plate connecting said pair of opposing studs at an upper integration point. The enhanced temporary protective structural system also includes a plurality of noggings connecting a first stud of said pair of opposing studs of said first frame member in said plurality of frame members with a first stud of said pair of opposing studs of said second frame member in said plurality of frame members, and a plurality of noggings connecting a second stud of said pair of opposing studs of said first frame member in said plurality of frame members with a second stud of said pair of opposing studs of said second frame member in said plurality of frame members, thereby forming at least one free-standing tunnel module. The enhanced temporary protective structural system 120 includes a plurality of ceiling joists connecting said top plate of each of said first frame members to a top plate of each of said second frame members, thereby securing said at least one free-standing tunnel module.

The enhanced temporary protective structural system includes at least one vertical wall panel 116 secured to an exterior area of said at least one free-standing tunnel module 120, thereby vertically enclosing said at least one free-standing tunnel module 120, other elements which may be seen in in my disclosure in application Ser. No. 18/105,814 include the at least one horizontal ceiling panel secured to an exterior ceiling area of said at least one free-standing tunnel module, and at least one horizontal floor panel, whereby said at least one horizontal ceiling panel and said at least one floor panel horizontally enclose said at least one free-standing tunnel module.

The enhanced temporary protective structural system also include at least one temporary stair tread cover 120, constructed of fluted plastic, and at least one temporary stair riser protector 118, having a vertically oriented main body 118*f* with two fold lines 118*c*/118*d* running parallel to a width of the main body 118*f*, wherein once folded, a top folded flap 118*b* horizontally extends away from the main body 118*f*, and a bottom folded flap 118*a* horizontally extends away from the main body 118*f* in a direction opposite of the direction of the top folded flap 118*b*, thereby creating an overlap between said top folded flap 118*b* and an upper stair tread cover 120 of said at least one stair tread cover 120 and an overlap between said bottom folded flap 118*a* and a lower stair tread cover 120 of said at least one stair tread cover 120. The enhanced temporary protective structural system includes at least a pair of stair anchors 124 configured to directionally secure the stair tread cover 120, wherein each stair anchor 124 in said pair of stair anchors 124 includes a vertical main body 124*d* with a horizontal fold line 124*a*, wherein once folded, a bottom folded flap 124*b* horizontally extends away from the main body 124*d* and overlaps said stair tread cover 120.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A method of providing surface protection during at least construction and demolition, comprising the steps of:

providing a temporary protective barrier system for floors and stairs comprising:

at least one temporary stair tread cover, composed of fluted plastic;

at least one temporary stair riser protector, having a vertically oriented main body with two fold lines running parallel to a width of the main body, wherein once folded, a top folded flap horizontally extends away from the main body, and a bottom folded flap horizontally extends away from the main body in a direction opposite of a direction of the top folded flap, thereby creating an overlap between said top folded flap and an upper stair tread cover of said at least one stair tread cover and an overlap between said bottom folded flap and a lower stair tread cover of said at least one stair tread cover; and at least a pair of stair anchors configured to directionally secure the stair tread cover, wherein each stair anchor in said pair of stair anchors includes a vertical main body with a horizontal fold line, wherein once folded, a bottom folded flap horizontally extends away from the main body and overlaps said stair tread cover;

measuring a length and height of a stairwell from a respective stair tread to an underside of a handrail, providing a sheet of fluted plastic material defining a wall panel and resting said sheet of fluted plastic material on an edge of the respective stair tread, and securing the sheet to a wall using the handrail as a mounting point anchor;

measuring a width and depth of the respective stair tread, ensuring all treads are equivalent in dimension, and cutting the stair tread cover down to a size equivalent to the width and depth of the respective stair tread, if modification is required to match the dimensions;

installing said stair tread cover over said respective stair tread;

measuring a height of a respective stair riser, modifying the stair riser protector if a smaller size is required, ensuring two inches of overlap of between the top flap and upper stair tread cover, and two inches of overlap between the bottom flap and bottom stair tread cover, once folded, and installing the stair riser protector on the respective stair tread; and measuring the width of the respective stair tread to confirm dimensions thereof, modifying each stair anchor to assimilate a width thereof with the depth of the respective stair tread, modifying each stair anchor's height to conform with a height equivalent to two-inches above the height of the respective stair riser, wherein a lower two-inches are folded inward and affixed to the stair tread cover, and installing each stair anchor against the wall sheet, securing all overlap points with adhesive tape.

2. The method as recited in claim 1, further comprising the step of:

installing a non-skid adhesive tape to a top surface of said stair tread cover one-inch from a forward edge of the tread.

3. The method as recited in claim 1, further comprising:

an adhesive element on a stair-facing engagement surface of each of said at least one temporary stair tread cover.

4. The method as recited in claim 1, further comprising: an adhesive element on a stair-facing engagement surface of each of said at least one temporary stair riser protector.

5. The method as recited in claim 1, further comprising: an adhesive element on a back surface of each stair anchor, whereby once folded along said fold line, said adhesive element on said back surface engages with both a wall or wall covering, and a respective stair tread cover.

6. The method as recited in claim 1, further comprising: an adhesive element on a back side of each stair anchor, whereby once folded along said fold line, said adhesive element on said back side engages with both a wall or wall covering, and a respective stair tread cover.

7. The method as recited in claim 1, further comprising: at least one unit of adhesive grip tape, wherein said grip tape is configured to engage at an upper forward surface of each of said stair tread covers; and an adhesive sealing tape configurable to seal seams between at least one of a pair component configurations, including seams between a pair of floor panels, seams between a floor panel and a stair riser protector, seams between a floor panel and a stair anchor, seams between a wall covering panel and a stair anchor, seams between a floor panel and a wall covering panel and a floor panel, seams between a stair anchor and a stair tread cover, seams between a stair tread cover and a stair riser protector, and seams between a stair riser protector and a stair anchor, whereby said sealing tape provides additional anchorage between each component, and keeps dust and liquid from seeping between said components.

8. The method as recited in claim 1, further comprising: at least one floor panel constructed of fluted plastic material.

9. The method as recited in claim 8, wherein said at least one floor panel includes an adhesive element on an underside of each floor panel of said at least one floor panel, whereby said adhesive element allows said floor panel to temporarily secure said floor panel to an underlying floor.

10. The method as recited in claim 1, further comprising: wherein said at least one wall panel is entirely constructed of fluted plastic material.

11. The method as recited in claim 10, wherein said at least one wall panel includes an adhesive element on an outside surface of each wall panel of said at least one wall panel, whereby said adhesive element allows said wall panel to temporarily secure said wall panel to a bordering wall of a staircase.

* * * * *